United States Patent [19]

Hattori

[11] 4,119,071

[45] Oct. 10, 1978

[54] EXHAUST GAS RECIRCULATING DEVICE IN AN INTERNAL COMBUSTION ENGINE

[75] Inventor: Kyo Hattori, Toyota, Japan

[73] Assignee: Toyota Jidosha Kogyo Kabushiki Kaisha, Toyota, Japan

[21] Appl. No.: 738,957

[22] Filed: Nov. 4, 1976

[30] Foreign Application Priority Data

Sep. 17, 1976 [JP] Japan ..... 51-110697

[51] Int. Cl.[2] ..... F02N 25/06

[52] U.S. Cl. ..... 123/119 A

[58] Field of Search ..... 123/119 A; 60/305

[56] References Cited

U.S. PATENT DOCUMENTS 3,385,053 5/1968 Honda et al. ..... 60/305

3,446,196 5/1969 Daigh ..... 123/119 A

FOREIGN PATENT DOCUMENTS 1,259,889 1/1972 United Kingdom ..... 123/119 A

*Primary Examiner*—Wendell E. Burns

*Attorney, Agent, or Firm*—Stevens, Davis, Miller & Mosher

[57] ABSTRACT

An internal combustion engine having an exhaust gas recirculating device for recirculating the exhaust gas into the intake passage from the exhaust system. A number of the exhaust gas outlet ports are formed on the inner wall of the intake passage at a distance from each other around the stem of the intake valve so that the combustible mixture introduced from the intake passage and the recirculated exhaust gas discharged from the exhaust gas outlet ports are alternately stratified in the combustion chamber.

15 Claims, 9 Drawing Figures

EXHAUST GAS RECIRCULATING DEVICE IN AN INTERNAL COMBUSTION ENGINE

DESCRIPTION OF THE INVENTION

The present invention relates to an exhaust gas recirculating device in an internal combustion engine. As a method for reducing an amount of the harmful $NO_x$ components in the exhaust gas, there is a well-known method in which the exhaust gas is recirculated into the intake system of an engine. In an exhaust gas recirculating device of this type, the exhaust gas is first fed into an air cleaner, a carburetor or an intake manifold, and then the exhaust gas becomes relatively well-mixed with the intake air. Subsequently, a mixture thus produced is introduced into the combustion chamber in the engine. In order to greatly reduce an amount of the harmful $NO_x$ components in the exhaust gas, when an amount of the recirculated exhaust gas is increased, the amount of the recirculated exhaust gas introduced into the region around the spark plug arranged in the combustion chamber is also increased. Consequently, ignition of the mixture becomes difficult under the influence of the exhaust gas. As a result of this, a fluctuation of the output torque due to the irregular rotation of the engine occurs, thus causing a decrease in the output power of the engine. In addition, fuel consumption is increased, and sometimes a problem can occur wherein the engine will not operate. Consequently, it is impossible to recirculate a large amount of the exhaust gas in the engine having the above-mentioned exhaust gas recirculating device.

On the other hand, as shown in FIG. 1, there has been proposed a method capable of recirculating a large amount of the exhaust gas while ensuring an ease of ignition of the mixture by means of the spark plug. In this method, as shown in FIG. 1, an exhaust gas recirculating pipe is disposed in the intake port of the engine and opens into the intake port near to the rear surface of the valve head of an intake valve at a position located opposite to the spark plug with respect to the axis of the intake valve. At the time of the intake stroke, the exhaust gas discharged from the exhaust gas recirculating pipe is deflected by the valve head of the intake valve. Then, the air-fuel mixture containing a large amount of the recirculated exhaust gas therein is introduced into the region in the combustion chamber remote from the spark plug. On the other hand, the air-fuel mixture containing no exhaust gas therein is introduced into the region around the spark gap of the spark plug, thus causing an ease of ignition of the mixture. However, as is aforementioned, if the recirculated exhaust gas is poorly distributed in the combustion chamber, the exhaust gas recirculating effect is lost. Consequently, even if a large amount of the exhaust gas is recirculated, it is practically impossible to effectively reduce an amount of the harmful $NO_x$ components in the exhaust gas.

An object of the present invention is to provide an exhaust gas recirculating device capable of recirculating a large amount of the exhaust gas and of ensuring an ease of ignition of the mixture.

According to the present invention, there is provided an internal combustion engine comprising, a combustion chamber having a piston reciprocally mounted therein, a cylinder head positioned over one end of said combustion chamber and having a hole therein, said hole having an inner wall defining an intake passage for feeding a combustible mixture into said combustion chamber, an intake valve having a valve and a stem with an axis, said intake valve being reciprocally mounted in said cylinder head to move along said axis for controlling the opening of said intake passage into said combustion chamber, an exhaust passage, a spark plug in said combustion chamber, at least two exhaust gas outlet ports disposed at a distance from each other around the axis of said stem of the intake valve on the inner wall defining said intake passage at a position near to the valve head of said intake valve for recirculating the exhaust gas into the intake passage at the time of the intake stroke of the engine, and an exhaust gas recirculating passage connecting said exhaust gas outlet ports with said exhaust passage and having therein valve means for controlling the flow rate of the recirculated exhaust gas, the combustible mixture and the recirculated exhaust gas introduced into said combustion chamber being alternately stratified in said combustion chamber.

The above-mentioned object of the present invention may be more fully understood from the following description of a preferred embodiment of the invention, together with the accompanying drawings.

DESCRIPTION OF PREFERRED EMBODIMENTS

Figure 1:
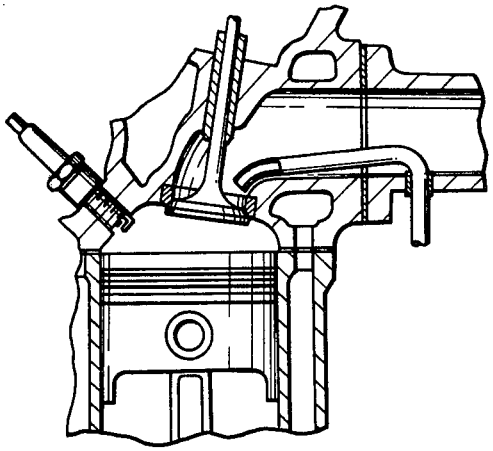
Fig. 1 PRIOR ART
FIG. 1 is a cross-sectional view of an internal combustion engine equipped with a conventional exhaust gas recirculating device.
Figure 2:
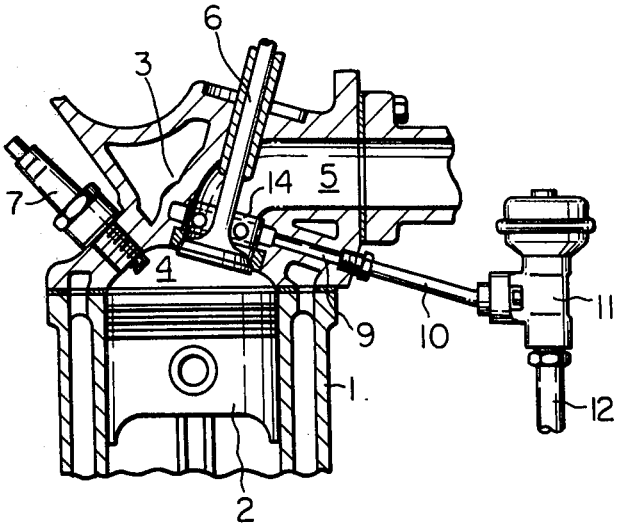
FIG. 2 is a cross-sectional view of an internal combustion engine equipped with an exhaust gas recirculating device according to the present invention.
Figure 3:
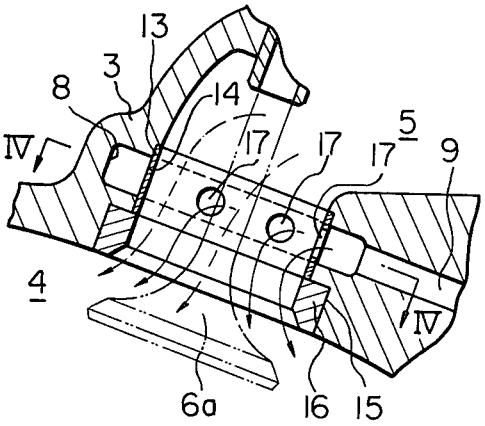
FIG. 3 is an enlarged view of a part of an internal combustion engine shown in FIG. 2.
Figure 4:
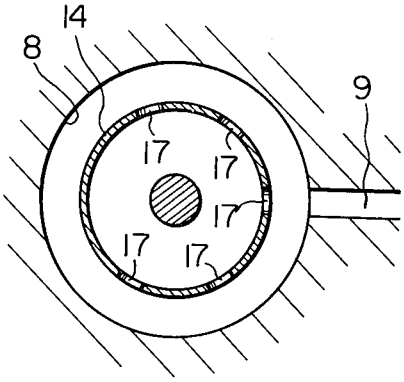
FIG. 4 is a cross-sectional view taken along the line IV—IV in FIG. 3.

Referring to FIG. 2, an internal combustion engine comprises a cylinder block 1, a piston 2 reciprocally movable in the cylinder block 1, a cylinder head 3 fixed onto the cylinder block 1, a combustion chamber 4 formed between the inner wall of the cylinder head 3 and the top surface of the piston 2, an intake port 5 formed in the cylinder head 3, an intake valve 6, an exhaust valve (not shown), and a spark plug having a spark gap located in the combustion chamber 4. The intake port 5 is connected to a combustible mixture forming device, for example, a carburetor (not shown). Referring to FIGS. 2 through 4, an annular groove 8 is formed on the inner wall of the intake port 5 at a position near to the rear surface 6*a* of the valve head of the intake valve 6, and is connected to an exhaust manifold (not shown) via an exhaust gas passage 9 formed in the cylinder head 3, a pipe 10, a recirculated exhaust gas flow control valve 11 and a pipe 12. A groove 13 is formed on the inner wall of the intake port 5 along the edges of the annular groove 8. An annular collar 14 is fitted into the groove 13 so as to cover the annular groove 8, and is held by the valve seat 16 which is fitted into a recess 15 after the annular collar 14 is fitted into the groove 13. The annular collar 14 is provided with a number of exhaust gas outlet ports 17. As is shown in FIG. 4, it is preferable that the exhaust gas outlet ports 17 should not be formed on the annular collar 14 on the spark plug side with respect to the axis of the intake valve 6.

At the time of the intake stroke, a combustible mixture is introduced into the combustion chamber 4 via the intake port 5. At the same time, the exhaust gas flows out from the exhaust gas outlet ports 17, and is introduced into the combustion chamber 4 together with the combustible mixture. Since the exhaust gas outlet ports 17 are arranged at a distance from each other, the combustible mixture and the exhaust gas discharged from the exhaust gas outlet ports 17 are introduced into the combustion chamber 4 while being alternately stratified. As is shown in FIG. 4, no exhaust gas outlet port 17 is formed on the annular collar 14 on the spark plug side thereof as determined with respect to the axis of the intake valve 6. Consequently, the combustible mixture containing no exhaust gas therein is introduced into the region around the spark gap of the spark plug 7. On the other hand, the entire space of the combustion chamber 4 except for the space around the spark gap of the spark plug 7 is filled with the alternately stratified layers of the respective combustible mixture and the exhaust gas. Consequently, the combustible mixture in the combustion chamber 4 is easily ignited by the spark plug 7 and, then, the combustion flame spreads to the entire space of the combustion chamber 4. At this time, the propagation of the combustion flame is controlled by the alternately stratified exhaust gas layers, thus causing the controlled combustion. This results in greatly reducing the amount of the production of $NO_x$ components.

Figure 5:
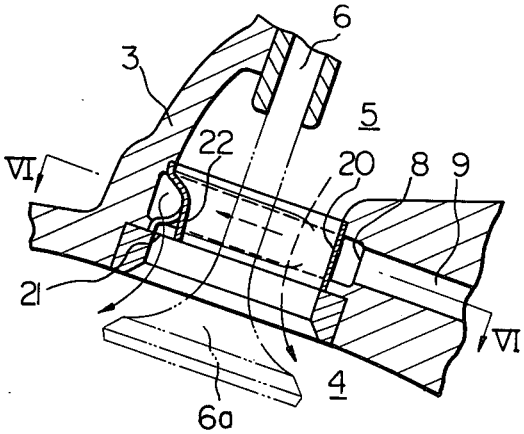
FIG. 5 is a cross-sectional view of another embodiment.
Figure 6:
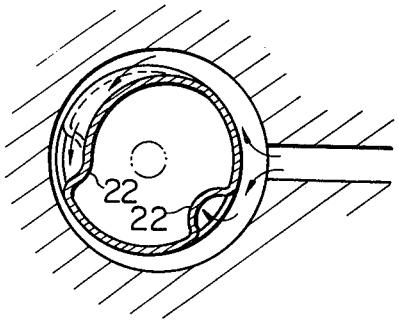
FIG. 6 is a cross-sectional view taken along the line VI—VI in FIG. 5.

In an embodiment shown in FIGS. 5 and 6, an annular collar 20 is provided with a recess portion 22 projecting into the intake port 5 and opening towards the rear surface 6*a* of the valve head of the intake valve 6. In this embodiment, two recess portions 22 are formed on the annular collar 20. However, it is preferable that more than two recess portions be formed on the annular collar 20. In this embodiment, the exhaust gas is discharged from the exhaust gas outlet ports 21 along the combustible mixture stream. Consequently, the exhaust gas is less disturbed by the combustible mixture stream if compared with the case as shown in FIGS. 2 through 4, whereby the combustible mixture and the exhaust gas are well-stratified.

Figure 7:
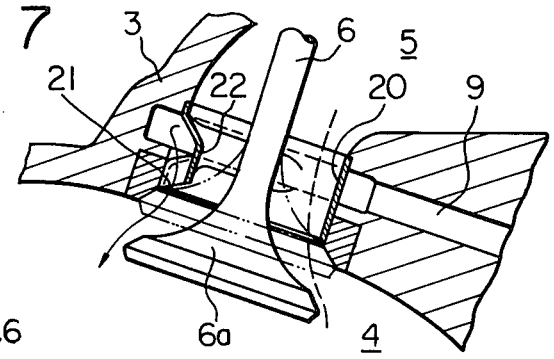
FIG. 7 is a cross-sectional view of a further embodiment.

Referring to FIG. 7 which shows a modified embodiment of FIG. 5, the recess portion 22 is formed so as to extend to the vicinity of the rear surface 6*a* of the valve head of the intake valve 6. Consequently, when the intake valve 6 is closed, the exhaust gas outlet ports 21 is instantaneously closed, thus preventing the leakage of the exhaust gas into the intake port 5 when the intake valve 6 is in the closed condition.

Figure 8:
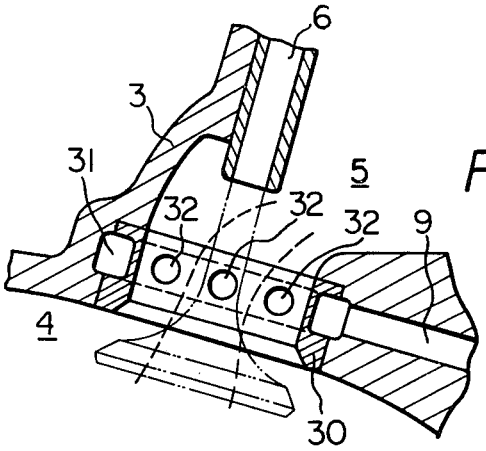
FIG. 8 is a cross-sectional view of a still further embodiment.

Referring to FIG. 8 which shows a further embodiment, an annular chamber 31 is formed between the inner wall of the intake port 5 and the valve seat 30, and a number of the exhaust gas outlet ports 32 is formed on the inner wall of the valve seat 30.

Figure 9:
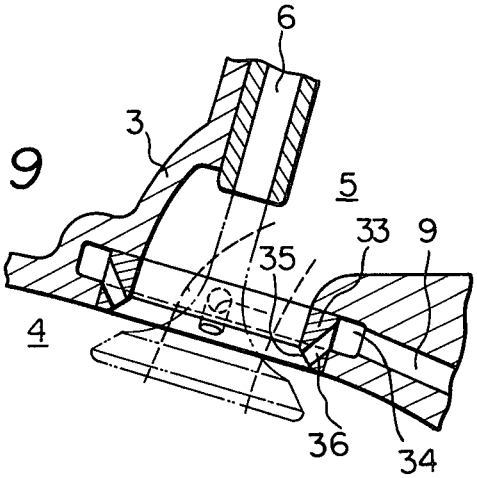
FIG. 9 is a cross-sectional view of a still further embodiment.

Referring to FIG. 9 which shows a still further embodiment, the annular chamber 34 is formed between the inner wall of the intake port 5 and the valve seat 33, and the exhaust gas outlet ports 36 opening on the valve seat face 35 are formed in the valve seat 33. In this embodiment, when the intake valve 6 is closed, the exhaust gas outlet ports 36 are completely closed by the intake valve 6, thereby completely preventing the leakage of the exhaust gas into the intake port 5 when the intake valve 6 is in the closed condition.

As a combustible mixture introduced into the combustion chamber 4 via the intake port 5, a mixture having an ordinary air-fuel ratio or a lean air-fuel mixture can be used. The present invention can be applied to an internal combustion engine with a subsidiary combustion chamber in which the subsidiary combustion chamber is only connected to the main combustion chamber and has a spark plug, wherein the combustible mixture introduced into the main combustion chamber is forced into the subsidiary combustion chamber, and wherein the combustible mixture introduced into the subsidiary combustion chamber is ignited. In addition, the present invention can also be applied to a stratified combustion type internal combustion engine provided with a subsidiary combustion chamber having a spark plug and a subsidiary intake valve, in which a rich air-fuel mixture is fed into the subsidiary combustion chamber and a lean air-fuel mixture is fed into the main combustion chamber, wherein the rich air-fuel mixture in the subsidiary combustion chamber is ignited, whereby a torch is injected into the main combustion chamber from the subsidiary combustion chamber.

According to the present invention, even if a large amount of the exhaust gas is recirculated, an ease of the ignition of a combustible mixture and a stable combustion can be obtained because the region around the spark gap of the spark plug is filled with the combustible mixture containing no exhaust gas therein and because the entire space of the combustion chamber except for the space around the spark gap of the spark plug is filled with alternately stratified layers of the combustible mixture and the recirculated exhaust gas. Consequently, an amount of the harmful $NO_x$ components in the exhaust gas can be greatly reduced.

What is claimed is:

1. An internal combustion engine comprising:

a combustion chamber having a piston reciprocally mounted therein;

a cylinder head positioned over one end of said combustion chamber, an inner wall in said cylinder head defining an intake passage for feeding a combustible mixture into said combustion chamber;

an intake valve having a head and a stem, said intake valve being reciprocally mounted in said cylinder head to move along the axis of the stem to control flow from said intake passage into said combustion chamber;

an exhaust passage;

a spark plug in said combustion chamber, at least two exhaust gas outlet ports disposed in the inner wall defining said intake passage at a position near to the valve head of said intake valve, said ports being circumferentially spaced from each other around the axis of said stem to recirculate the exhaust gas into the intake passage at the time of the intake stroke of the engine, said circumferentially spaced exhaust ports being arranged to alternately stratify said combustible mixture and said recirculated exhaust gas and to supply the alternately stratified layers of said combustible mixture and said recirculated exhaust gas to substantially the entire interior of said combustion chamber except in the region of said spark plug where only said combustible mixture is supplied; and, an exhaust gas recirculating passage connecting said exhaust gas outlet ports with said exhaust passage and having therein valve means for controlling the flow rate of the recirculated exhaust gas.

2. An internal combustion engine as recited in claim 1, wherein an annular chamber connected to said exhaust gas recirculating passage is formed in said inner wall of said intake passage, said exhaust gas outlet ports being connected to said annular chamber.

3. An internal combustion engine as recited in claim 2, wherein said annular chamber is formed between a cylindrical collar fitted onto said inner wall of said intake passage and an annular groove formed on said inner wall, said exhaust gas outlet ports being formed on said annular collar.

4. An internal combustion engine as recited in claim 2, wherein said annular chamber is formed between a collar fitted onto said inner wall of said intake passage and an annular groove formed on said inner wall, said collar having recess portions which project into said intake passage and form said exhaust gas outlet ports opening towards said valve head of said intake valve.

5. An internal combustion engine as recited in claim 4, in which the valve head of said intake valve has a front surface facing the combustion chamber and a rear surface located opposite to said front surface, wherein said exhaust gas outlet ports are positioned adjacent to said rear surface of said valve head when said intake valve is in the closed position.

6. An internal combustion engine as recited in claim 2, in which the valve head of said intake valve has a face, a valve seat being mounted on said inner wall of said intake passage for receiving said face of said valve head, wherein said annular chamber is formed between said valve seat and an annular groove formed on said inner wall of said intake passage, said exhaust gas outlet ports being formed on said valve seat.

7. An internal combustion engine as recited in claim 6, wherein said exhaust gas outlet ports are closed by said face of the valve head when said intake valve is closed.

8. An internal combustion engine as recited in claim 1, wherein said exhaust gas outlet ports are disposed on said inner wall of said intake passage except for the area of said inner wall on the ignition plug side with respect to the axis of the stem of the intake valve.

9. An internal combustion engine as recited in claim 1, wherein said combustion chamber comprises a main combustion chamber and a subsidiary combustion chamber, said spark plug being disposed in said subsidiary combustion chamber.

10. An internal combustion engine as recited in claim 9, wherein said subsidiary combustion chamber is connected only to said main combustion chamber, the combustible mixture being introduced only into said main combustion chamber.

11. An internal combustion engine as recited in claim 10, wherein said combustible mixture has an approximately stoichiometric air-fuel ratio.

12. An internal combustion engine as recited in claim 10, wherein said combustible mixture is a lean air-fuel mixture.

13. An internal combustion engine as recited in claim 9, wherein said subsidiary combustion chamber has a subsidiary intake valve, a rich air-fuel mixture being introduced into said subsidiary combustion chamber via said subsidiary combustion chamber and a lean air-fuel mixture being introduced into said main combustion chamber.

14. An internal combustion engine as recited in claim 1, wherein said ports direct said exhaust gas into said intake passage at a direction perpendicular to the direction of flow of said combustible mixture into said cylinder.

15. An internal combustion engine as recited in claim 1, wherein said ports direct said exhaust gas into said intake passage in a direction extending toward said combustion chamber.

* * * * *